US006842721B2

(12) United States Patent
Kim et al.

(10) Patent No.: US 6,842,721 B2
(45) Date of Patent: Jan. 11, 2005

(54) REFRIGERATOR AND METHOD FOR CONTROLLING THE SAME

(75) Inventors: Tae Young Kim, Changwon (KR); Dae Gui Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/375,077

(22) Filed: Feb. 28, 2003

(65) Prior Publication Data

US 2003/0136135 A1 Jul. 24, 2003

Related U.S. Application Data

(62) Division of application No. 09/879,891, filed on Jun. 14, 2001, now abandoned.

(30) Foreign Application Priority Data

Jun. 16, 2000 (KR) ..... 2000-33197
Dec. 6, 2000 (KR) ..... 2000-73730

(51) Int. Cl.[7] ..... G06F 11/30
(52) U.S. Cl. ..... 702/188; 725/110; 725/133
(58) Field of Search ..... 725/110, 133, 725/141, 153; 701/29, 32, 33, 203, 207; 395/240; 705/26; 702/188

(56) References Cited

U.S. PATENT DOCUMENTS 5,398,251 A 3/1995 Shim ..... 62/126
5,699,528 A * 12/1997 Hogan ..... 705/40
6,003,070 A 12/1999 Frantz ..... 709/202
6,330,499 B1 * 12/2001 Chou et al. ..... 701/33

FOREIGN PATENT DOCUMENTS

| | | |
|---|---|---|
| JP | 10154181 | 6/1998 |
| JP | 2000-154959 | 6/2000 |
| JP | 2000-154969 | 6/2000 |

OTHER PUBLICATIONS

Horowitz and Hill, "The Art of Electronics," Cambridge University Press, 1989, p. 587.

* cited by examiner

*Primary Examiner*—John Barlow
*Assistant Examiner*—Stephen J. Cherry
(74) *Attorney, Agent, or Firm*—Fleshner & Kim, LLP

(57) ABSTRACT

In a method for requesting a repair of a refrigerator through the Internet and a system therefor, and particularly in a refrigerator and a method for controlling the same, a failure of a refrigerator can be quickly and accurately repaired although a user can not recognize the failure of the refrigerator by setting a self-checkup function of a refrigerator, comparing failure relation data sensed by various sensing means to preset reference data stored in a database and transmitting a compared result to a service center or a serviceman through the Internet.

11 Claims, 7 Drawing Sheets

REFRIGERATOR AND METHOD FOR CONTROLLING THE SAME

This application is a divisional of U.S. patent application Ser. No. 09/879,891 filed Jun. 14, 2001, now abandoned the contents of which are incorporated herein by reference.

BACKGROUND OF THE INVENTION

1. Field of the Invention

The present invention relates to a refrigerator, and in particular to a refrigerator and a method for controlling the same which is capable of performing a self-checkup of a failure state of a refrigerator and transmitting automatically failure relation information to a service center through the Internet.

2. Background of the Related Art

Generally, a refrigerator has a refrigeration cycle absorbing heat inside a cooling chamber and a freezing chamber and emitting the absorbed heat outside of the cooling chamber and freezing chamber in order to maintain a temperature inside the cooling chamber and freezing chamber lower than a room temperature. An evaporator (cooler) (not shown) absorbs the heat inside the cooling chamber and freezing chamber at a temperature lower than a temperature inside the cooling chamber and freezing chamber.

In general, in order to maintain the temperature inside the freezing chamber not greater than −18° C., a temperature of the evaporator has to be not greater than −23° C.

Accordingly, the temperature of the evaporator is the lowest inside the cooling chamber and freezing chamber, most of moisture inside the cooling chamber and freezing chamber is gathered at the evaporator having the lowest temperature, when there is a certain amount of moisture (frost) inside the cooling chamber and freezing chamber, efficiency of the evaporator decreases, accordingly the moisture (frost) has to be removed periodically.

FIG. 1 is a perspective view illustrating a general refrigerator in accordance with the prior art.

As depicted in FIG. 1, a refrigerator includes a freezing chamber 3, a cooling chamber 4 for storing (preserving) foodstuff, and doors 2, 5 for selectively opening and closing the freezing chamber 3 and cooling chamber 4. In more detail the refrigerator 1 can keep freshness of the foodstuff stored in the freezing chamber 3 and cooling chamber 4 by maintaining a temperature inside the freezing chamber 3 and cooling chamber 4 at a certain degree.

In order to maintain the freshness of the foodstuff stored in the freezing chamber 3 and cooling chamber 4, the refrigerator 1 has a refrigeration cycle constructed with a compressor (not shown) compressing a refrigerant, an evaporator (not shown) generating cool air for absorbing heat in the foodstuff stored in the refrigerator, an expansion valve (not shown) decompressing the refrigerant high-pressurized in the evaporator, and a condenser (not shown) condensing the refrigerant from the expansion valve into a liquid. When the refrigerant cycle is used for the refrigerator 1, a temperature inside the freezing chamber 3 and cooling chamber 4 is set by the cool air which is generated from the evaporator and circulates the freezing chamber 3 and cooling chamber 4.

However, when the refrigerator 1 gets out of order, generally a user can not know accurately a cause of a failure and requests a repair to a serviceman through a telephone, a fax, etc. However, calling directly to the serviceman may be troublesome for a certain users. In more detail, when user calls a serviceman, the serviceman can judge a cause of a failure by asking a few questions to the user through the telephone, but not all of users can give right answers to questions of the serviceman. For example, a user who does not know well electric appliances can not answer back to the questions of the serviceman.

After calling the serviceman, although the serviceman visits and judges a cause of the failure accurately, when there are no required parts or equipment, the serviceman can not repair the failure and has to visit again.

In the meantime, a user can be damaged by a failure of the refrigerator when the user does not recognize the failure of the refrigerator. For example, when a temperature set function does not work well, the foodstuff stored in the freezing chamber 3 and cooling chamber 4 loses freshness and has gone bad in the worst case.

Hereinafter, the construction and operation of the refrigerator 1 will now be described with reference to accompanying FIG. 2.

FIG. 2 is a block diagram illustrating the construction of an operation control apparatus of a refrigerator in accordance with the prior art.

As depicted in FIG. 2, the operation control apparatus includes power unit 24 supplying AC power, a temperature sensing unit 26 sensing a temperature inside the freezing chamber 3 and cooling chamber 4 by using a sensor and outputting a sense signal, an input unit 22 outputting an order signal according to a request signal from a user, a microcomputer 25 operated by the AC power supplied from the power unit 24, outputting various control signals in accordance with the sense signal from the temperature sensing unit 26 and performing the operation corresponded to an order outputted from the input unit 22, a display unit 21 displaying a present state (temperature) of the freezing chamber 3 and cooling chamber 4 in accordance with the control signal of the microcomputer 25, and a load unit 23 operating a motor (not shown) of the compressor in accordance with a control signal of the microcomputer 25.

First, the power unit 24 supplies AC power to the microcomputer 25.

The microcomputer 25 controls each construction part of the refrigerator 1 after being supplied the AC power from the power unit 24. In more detail, the microcomputer 25 is inputted a sense signal outputted from the temperature sensing unit 26 and controls the load unit 23. Herein, the load unit 23 operates the refrigerator 1 in accordance with the control signal from the microcomputer 25. In addition, the microcomputer 25 is inputted the sense signal from the temperature sensing unit 26 and controls the display unit 21. Herein, the display unit 21 displays a present state (temperature) in accordance with the control signal from the microcomputer 25 in order to inform a user of the present state (temperature) of the refrigerator.

In the meantime, the microcomputer 25 judges whether the temperature inside the freezing chamber 3 and cooling chamber 4 sensed through the temperature sensing unit 26 is higher than an initial set temperature.

In the judging process, when the temperature inside the freezing chamber 3 and cooling chamber 4 is lower than the initial set temperature, the microcomputer 25 controls the load unit 23 so as to turn the motor of the compressor off.

On the contrary, in the judging process, when the temperature inside the freezing chamber 3 and cooling chamber 4 is higher than the initial set temperature, the microcomputer 25 controls the load unit 23 so as to turn the motor of the compressor on. In more detail, the microcomputer 25 adjusts a temperature inside the freezing chamber 3 and cooling chamber 4 by controlling the load unit 23 repeatedly so as to turn the motor of the compressor on when the temperature inside the freezing chamber 3 and cooling chamber 4 is higher than the initial set temperature or controlling the load unit 23 so as to turn the motor of the compressor off when the temperature inside the freezing chamber 3 and cooling chamber 4 is lower than the initial set temperature.

However, when the refrigerator is out of order, the user has to request a repair through a telephone or in written form after checking a function failure part or a defect in parts. After that, a serviceman visits and checks the failure, but because it takes time to check the function failure and prepare required parts, quick service can not be provided.

As described above, in the refrigerator 1 in accordance with the prior art, when the refrigerator 1 gets out of order, the user who do not fully understand electric appliances can not answer properly to questions of the serviceman.

In addition, when the refrigerator 1 gets out of order, although the serviceman visits and judges a cause of failure accurately, when there is no required parts or equipment, the serviceman has to visit again, accordingly quick and accurate service can not be provided.

In addition, when the user does not recognize the failure of the refrigerator, the foodstuff stored in the freezing chamber 3 and cooling chamber 4 loses freshness and has gone bad in the worst case.

SUMMARY OF THE INVENTION

Accordingly, it is an object of the present invention to provide a refrigerator and a method for controlling the same which is capable of repairing quickly a failure of a refrigerator by detecting instantly the failure in a refrigerator and automatically transmitting information about the failure to a service center or a serviceman through an electronic mail.

In order to achieve the object of the present invention, there is provided a method for controlling a refrigerator in accordance with the present invention including sensing a failure state of each part of a refrigerator, generating failure relation information corresponded to the failure state, and transmitting the failure relation information through the Internet.

In order to achieve the object of the present invention, there is provided a refrigerator in accordance with the present invention including a sensing means outputting first data after sensing a temperature state inside a storing space of a refrigerator and a failure state of each part inside the refrigerator, a control unit generating failure relation information on the basis of the outputted first data and preset second data, and an automatic mail transmitting unit converting the failure relation information into character information and transmitting the character information through the Internet.

In order to achieve the object of the present invention, in an apparatus controlling operation of a refrigerator after being inputted AC power, there is provided a refrigerator in accordance with the present invention including a temperature sensing unit sensing a temperature inside a storage and outputting a sense signal, a microcomputer outputting a control signal in accordance with the sense signal, sensing a failure of each part inside a refrigerator, coding failure relation information corresponded to the failure, and outputting the coded failure relation information, a communication unit being inputted the coded failure relation information and transmitting the coded failure relation information to a digital controller unit, a digital controller unit converting the coded failure relation information transmitted from the communication unit into character information by performing a digital signal-processing of the coded failure relation information, and an automatic mail transmitting unit automatically transmitting the character information to a designated address through an electronic mail.

DETAILED DESCRIPTION OF PREFERRED EMBODIMENTS

Hereinafter, the preferred embodiments of a refrigerator and a method for controlling the same will now be described in detail with reference to accompanying FIGS. 3–7.

Figure 1:
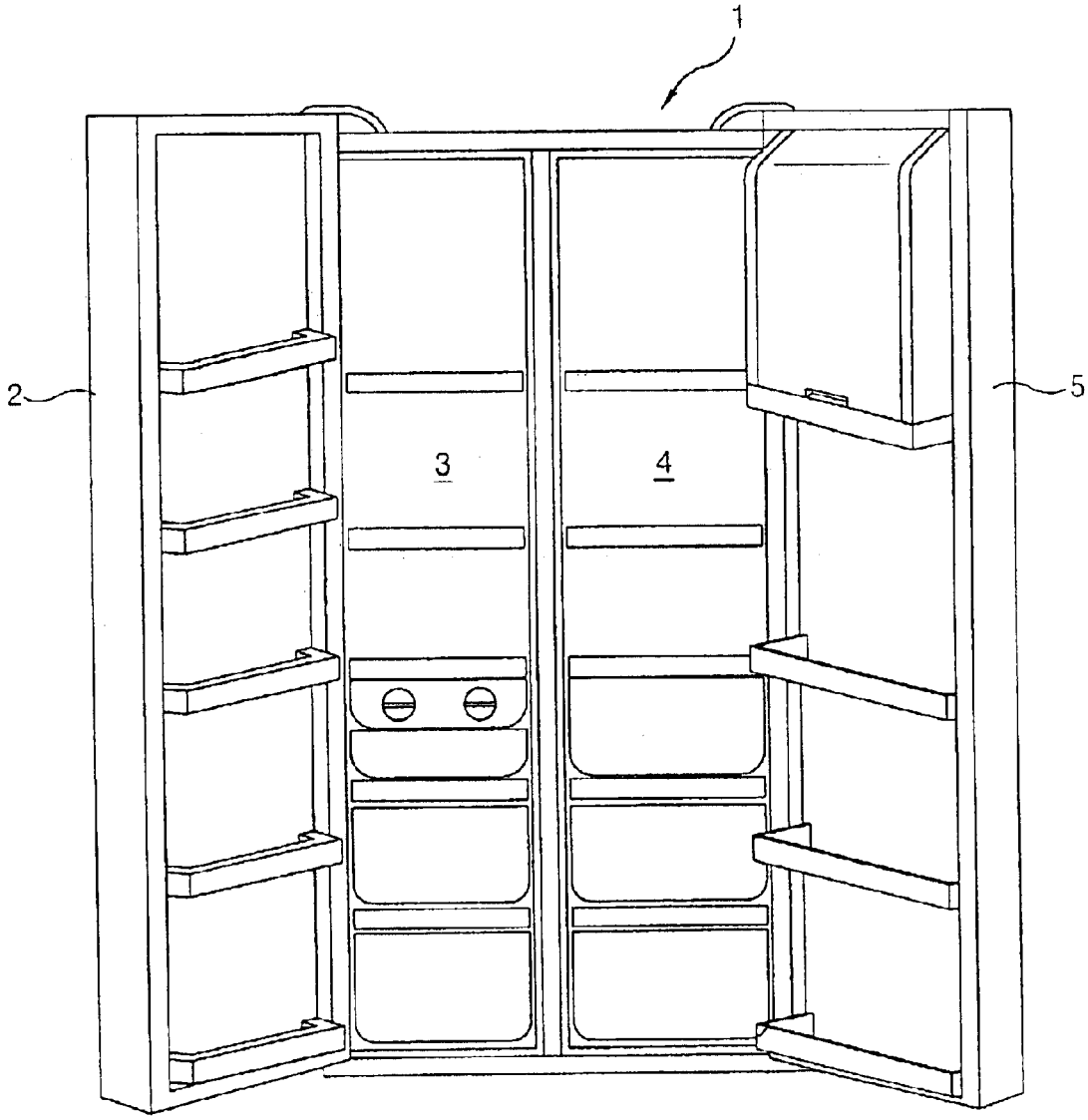
FIG.1 CONVENTIONAL ART
FIG. 1 is a perspective view illustrating a general refrigerator in accordance with the prior art.
Figure 2:
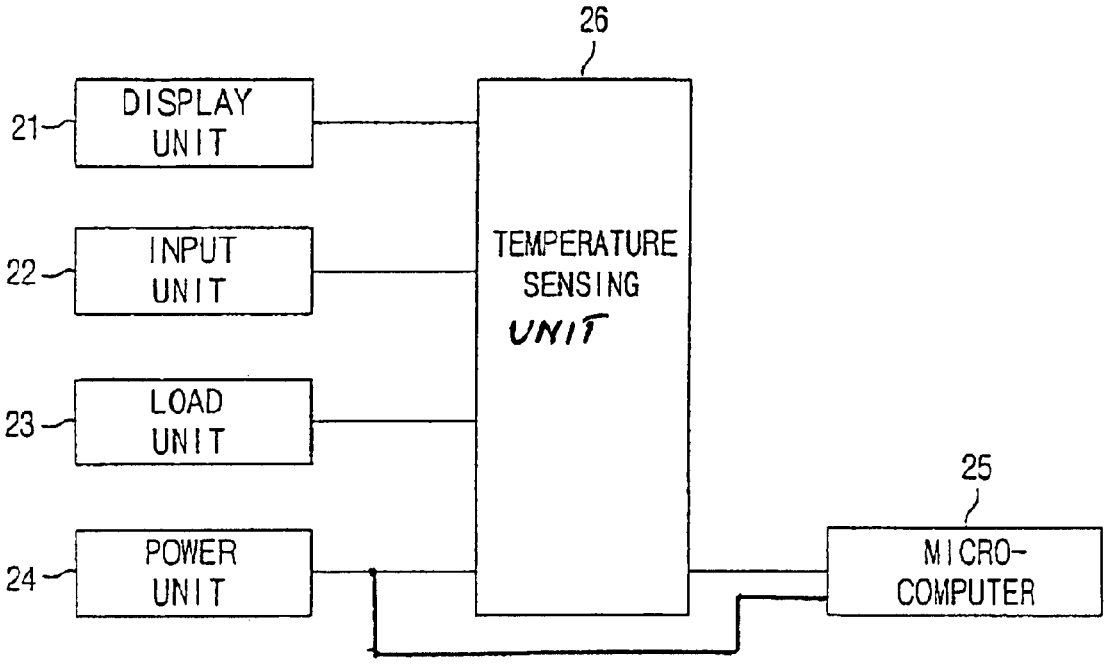
FIG.2 CONVENTIONAL ART
FIG. 2 is a block diagram illustrating construction of an operation control apparatus of a refrigerator in accordance with the prior art.
Figure 3:
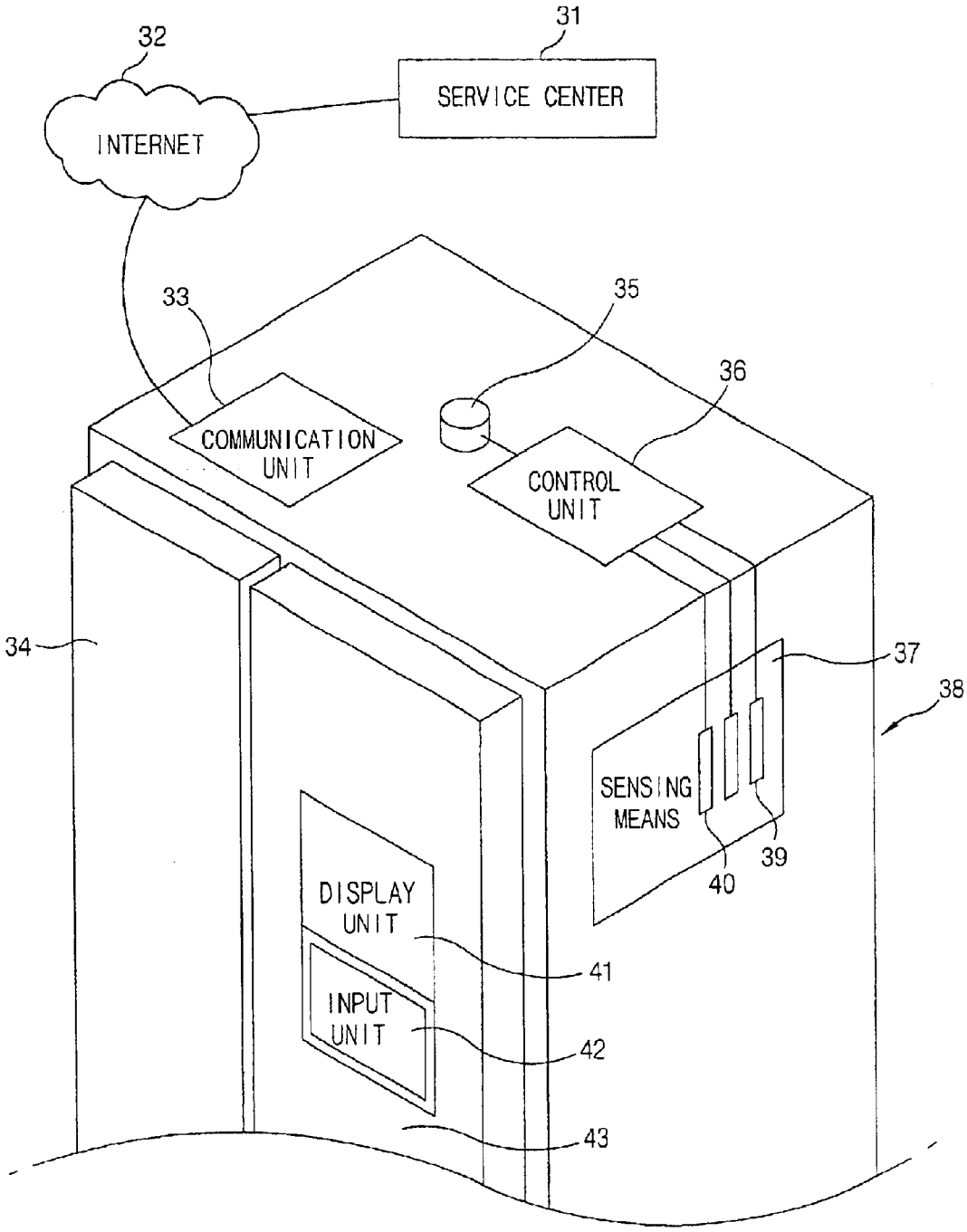
FIG. 3 is a block diagram illustrating a service request system of a refrigerator using the Internet in accordance with a first embodiment of the present invention.

FIG. 3 is a block diagram illustrating a service request system of a refrigerator using the Internet in accordance with a first embodiment of the present invention.

As depicted in FIG. 3, a refrigerator 38 in accordance with the present invention includes a display unit 41 installed at a door 43 of the refrigerator and displaying various data (information), an input unit 42 installed at the display unit 41 and outputting an order signal in accordance with a request signal of a user, a database 35 presetting information related to a failure state of the refrigerator 38 and storing the information, a sensing means 37 sensing data (information) corresponded to a failure state of each part of the refrigerator 38 and outputting the data, a control unit 36 comparing the outputted data to the preset data of the database 35 according to an order signal outputted from the input unit 42 and outputting user information, intrinsic information and failure relation information of a product according to a comparing result, a communication unit 33 transmitting the user information, the intrinsic information and the failure relation information of the product to a service center or a serviceman through the Internet 32, and a service center 31 being inputted the user information, the intrinsic information and the failure relation information of the product and processing the information. Herein, the sensing means 37 includes a temperature sensor 40 sensing a temperature of a cooling chamber or a freezing chamber and a power sensor 39 sensing power applied to the each part. The operation of the refrigerator 38 in accordance with the present invention will now be described in detail.

First, the display unit 41 is installed at the front surface of the door 43 and displays various information. Herein, the display unit 41 can be a simple liquid crystal screen or a liquid crystal screen having a touch-screen function. In more detail, when the liquid crystal screen having the touch-screen function is used as the display unit 41, the display unit 41 itself can be used as an input unit. In addition, the input unit 42 can be installed separately. Herein, the input unit 42 is installed at the display unit 41 and outputs an order signal in accordance with a request signal of a user.

The database 35 presets information (various data) related to a failure state of the refrigerator 38 and stores it. In more detail, the database 35 stores in advance temperature data corresponded to a failure state of a freezing chamber and a cooling chamber. In addition, the database 35 stores data related to an operation state of a compressor included in a refrigerant cycle. Herein, the control unit 36 judges a failure state of the refrigerator 38 by comparing the data stored in the database 35 to the data (information) corresponded to a failure state of the each part of the refrigerator 38. In other words, the data stored in the database 35 is used as a reference judging a failure state of the each part of the refrigerator 38.

The sensing means 37 senses data (information) corresponded to a failure state of the each part of the refrigerator 38 and outputs the sensed data. In more detail, the sensing means 37 sensing various states of the refrigerator 38 is constructed with a temperature sensor 40 sensing a temperature of a freezing chamber or a cooling chamber and a power sensor 39 sensing power applied to the each part. In addition, the sensing means 37 senses data related to functions of the each part.

The control unit 36 controls the each part of the refrigerator 38, controls the display unit 41 so as to display various information and performs a pertinent function in accordance with an order signal outputted from the input unit 42 according to a user request signal. In other words, the control unit 36 compares the sensed data and the data stored in advance in the database 35 in accordance with the order signal from the input unit 42 and outputs the user information, the intrinsic information and the failure relation information of the product when there is a failure in the sensed data.

The communication unit 33 receives/transmits various information from/to the service center 31 in accordance with the control signal of the control unit 36. In other words, the communication unit 33 transmits the user information, the intrinsic information and the failure relation information of the product to the service center 31 through the Internet 32. For example, the communication unit 33 transmits information related to a failure state of the each part of the refrigerator 38 to the service center 31 through an electronic mail in order to inform a serviceman of the failure state of the refrigerator 38. Herein, a modem can be used as the communication unit 33. In addition, the communication unit 33 can contact to the service center 31 through a network or an one-to-one communication, etc.

The service center 31 requests a repair of a pertinent refrigerator to the serviceman on the basis of the user information, the intrinsic information and the failure relation information of the product. In addition, the service center 31 outputs a confirmation signal notifying the reception of the intrinsic information and the failure relation information to the communication unit 33. Herein, the control unit 36 is inputted the confirmation signal from the communication unit 33, converts it into a character signal and outputs it to the display unit 41. The display unit 41 displays the character signal.

Hereinafter, the method for controlling the service request system of the refrigerator using the Internet will now be described in detail with reference to accompanying FIG. 4.

Figure 4:
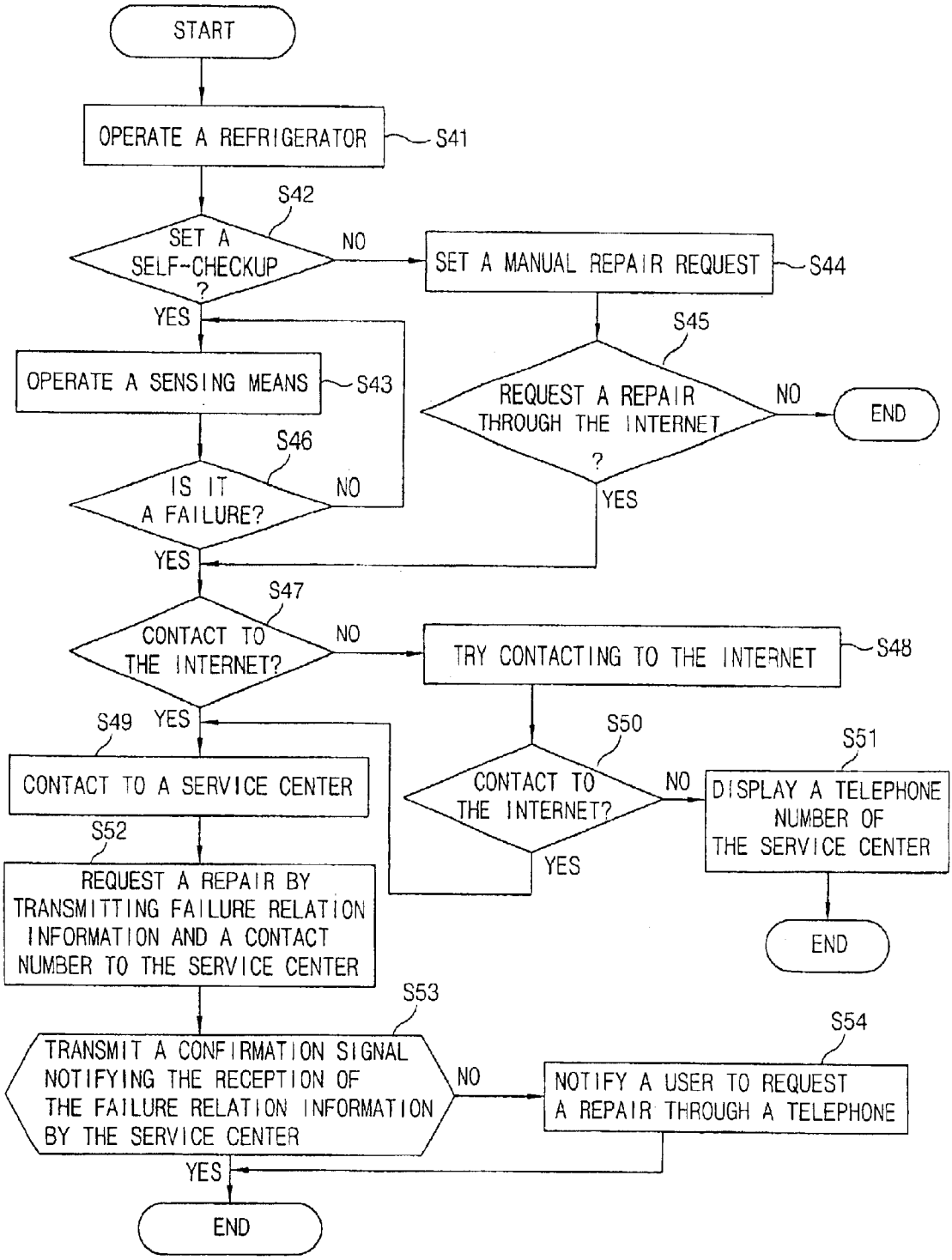
FIG. 4 is a flow chart illustrating a method for controlling the service request system of the refrigerator using the Internet in accordance with the first embodiment of the present invention.

FIG. 4 is a flow chart illustrating a method for controlling the service request system of the refrigerator using the Internet in accordance with the first embodiment of the present invention.

First, power is applied to the refrigerator 38 and the refrigerator 38 operates as shown at S41, cool air is generated by a freezing cycle of the refrigerator 38, the cool air maintains the freezing chamber and the cooling chamber at a certain temperature while circulating the freezing chamber and the cooling chamber.

When the refrigerator operates as shown at S41, the control unit 36 judges whether a self-checkup function of the refrigerator is set as shown at S42. In more detail, when the user presses a self-checkup button (not shown) of the input unit 42, the control unit 36 sets the self-checkup function. Herein, the sensing means 37 senses data corresponded to a failure state of the each part of the refrigerator 38 in accordance with the control signal of the control unit 36 and outputs the sensed data as shown at S43.

After that, the control unit 36 judges whether the refrigerator 38 is out of order by comparing the data outputted from the sensing means 37 to the data stored in the database 35 as shown at S46. In more detail, the data sensed from the sensing means 37 is outputted to the control unit 36, the control unit 36 judges whether the refrigerator 38 is out of order by comparing the data outputted from the sensing means 37 to the data stored in the database 35 (outputting failure relation information). When it is judged the refrigerator 38 is not out of order, the sensing process as shown at S43 for sensing data corresponded to a failure state of the each part of the refrigerator 38 is performed repeatedly.

On the contrary, in the judging process for judging a failure of the refrigerator 38 as shown at S46, when it is judged the refrigerator 38 is out of order, the control unit 36 judges whether the communication unit 33 contacts to the Internet 38 as shown at S47. In more detail, when it is judged the refrigerator 38 is out of order, the control unit 36 controls the communication unit 33 so as to contact to the Internet 32. Herein, the communication unit 33 may already contacts to the Internet 32.

In the meantime, when the self-checkup function is not set, a manual service (repair) request process is set as shown at S44. Herein, the manual service request process means a user personally judges a failure state of the refrigerator 38 (each part of the refrigerator 38) and inputs a failure state directly through the input unit 42.

When the manual service request process is set as shown at S44, the control unit 36 requests the user to report the failure state of the refrigerator 38 through the Internet 32 as shown at S45. When the user reports the failure state of the refrigerator 38 through the Internet 32, the control unit 36 judges whether the communication unit 33 contacts to the Internet 32 as shown at S47.

The control unit 36 judges whether the communication unit 33 contacts to the Internet 32 as shown at S50.

When contacting to the Internet 32 is not performed, the display unit 10 displays failure relation information and a contact number (telephone number) of the service center, etc. on a liquid display screen so as to make the user report the failure state of the refrigerator 38 to the service center 31 through a telephone in accordance with a control signal of the control unit 36 as shown at S51.

In the meantime, the communication unit 33 contacts to the Internet 32 and contacts to the service center 31 as shown at S49.

When the communication unit 33 contacts to the service center 60 through the Internet 32, the control unit 36 transmits information, namely, the user information, the intrinsic information and the failure relation information of the product as shown at S52. And, the user information can be a user's address, a user's telephone number and a user's name, etc. In addition, the intrinsic information of the product can be a model number or a model name of the refrigerator. In addition, the control unit 36 can transmit other information (data) related to service.

After that, the service center 31 transmits a confirmation signal confirming a reception of the user information, the intrinsic information and the failure relation information of the product to the communication unit 33 as shown at S53. Herein, when the confirmation signal is inputted to the communication unit 33, the control unit 36 ends the transmitting process for transmitting the user information, the intrinsic information and the failure relation information of the product through the internet.

In the meantime, when the confirmation signal is not received to the communication unit 33, the display unit 41 displays a telephone number of the service center in order to make the user contact to the service center through a telephone in accordance with the control signal from the control unit 36 as shown at S54.

Hereinafter, a service request system of a refrigerator using the Internet in accordance with a second embodiment of the present invention will now be described with reference to accompanying FIG. 5.

Figure 5:
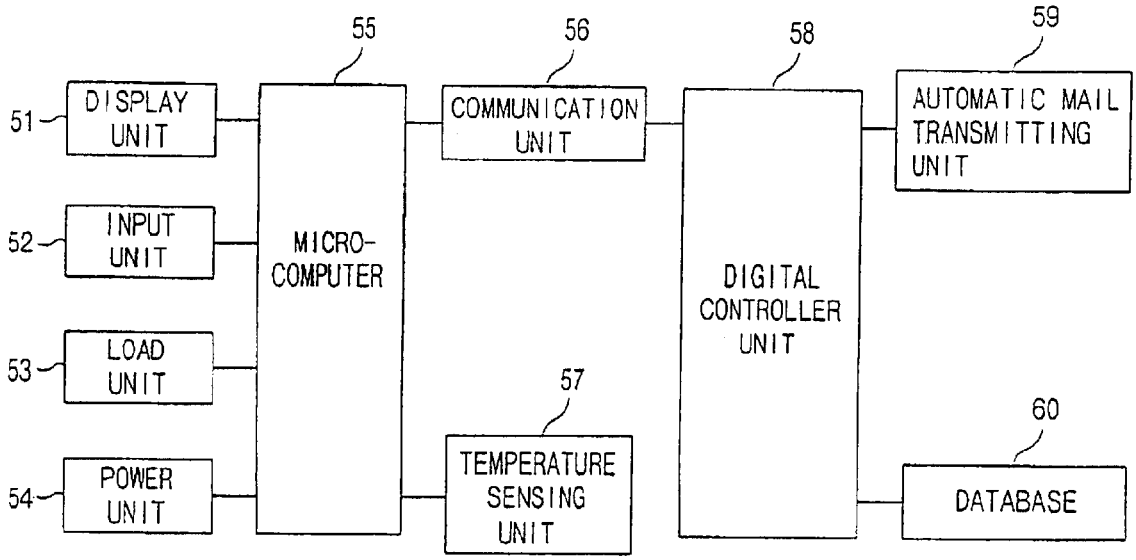
FIG. 5 is a block diagram illustrating a service request system of a refrigerator using the Internet in accordance with a second embodiment of the present invention.

FIG. 5 is a block diagram illustrating a service request system of a refrigerator using the Internet in accordance with a second embodiment of the present invention. In more detail, when a failure occurs in a certain part of the refrigerator 38, a service request system of a refrigerator using the Internet in accordance with the second embodiment of the present invention can automatically transmit an electronic mail about the failure to the service center or the serviceman.

As depicted in FIG. 5, a service request system of a refrigerator using the Internet in accordance with the second embodiment of the present invention includes a power unit 54 supplying AC power 54, a temperature sensing unit 57 sensing a temperature inside a freezing chamber and a cooling chamber by using a sensor and outputting a sense signal, an input unit 57 outputting an order signal about a request function according to a request signal of a user, a microcomputer 55 outputting a control signal for controlling each part of the refrigerator 38 according to the sense signal outputted from the temperature sensing unit 57 and the order signal outputted from the input unit 52, sensing a failure state at a certain part of the refrigerator 38 and outputting coded failure relation information corresponded to the failure state of the certain part, a display unit 51 displaying a present state of the refrigerator 38 (a present temperature inside the freezing chamber and the cooling chamber) in accordance with a control signal of the microcomputer 55, a load unit 53 operating the motor of the compressor in accordance with the control signal of the microcomputer 55, a communication unit 56 being inputted the coded failure relation information from the microcomputer 55 and transmitting the coded failure relation information to the service center, a database 60 storing user information (a users address, a user's telephone number, a user's name, etc.), product information (a model name or a model number of a refrigerator, an intrinsic number of a refrigerator), a digital controller unit 58 converting the coded failure relation information outputted from the communication unit 10 into character information (signal) by performing a digital signal processing of the coded failure relation information, and an automatic mail transmitting unit 59 automatically transmitting the character information outputted from the digital controller unit 58 and the user information and the product information stored in the database 60 to a designated address through an electronic mail. Herein, the construction of the communication unit 56 will now be described in detail with reference to accompanying FIG. 6.

Figure 6:
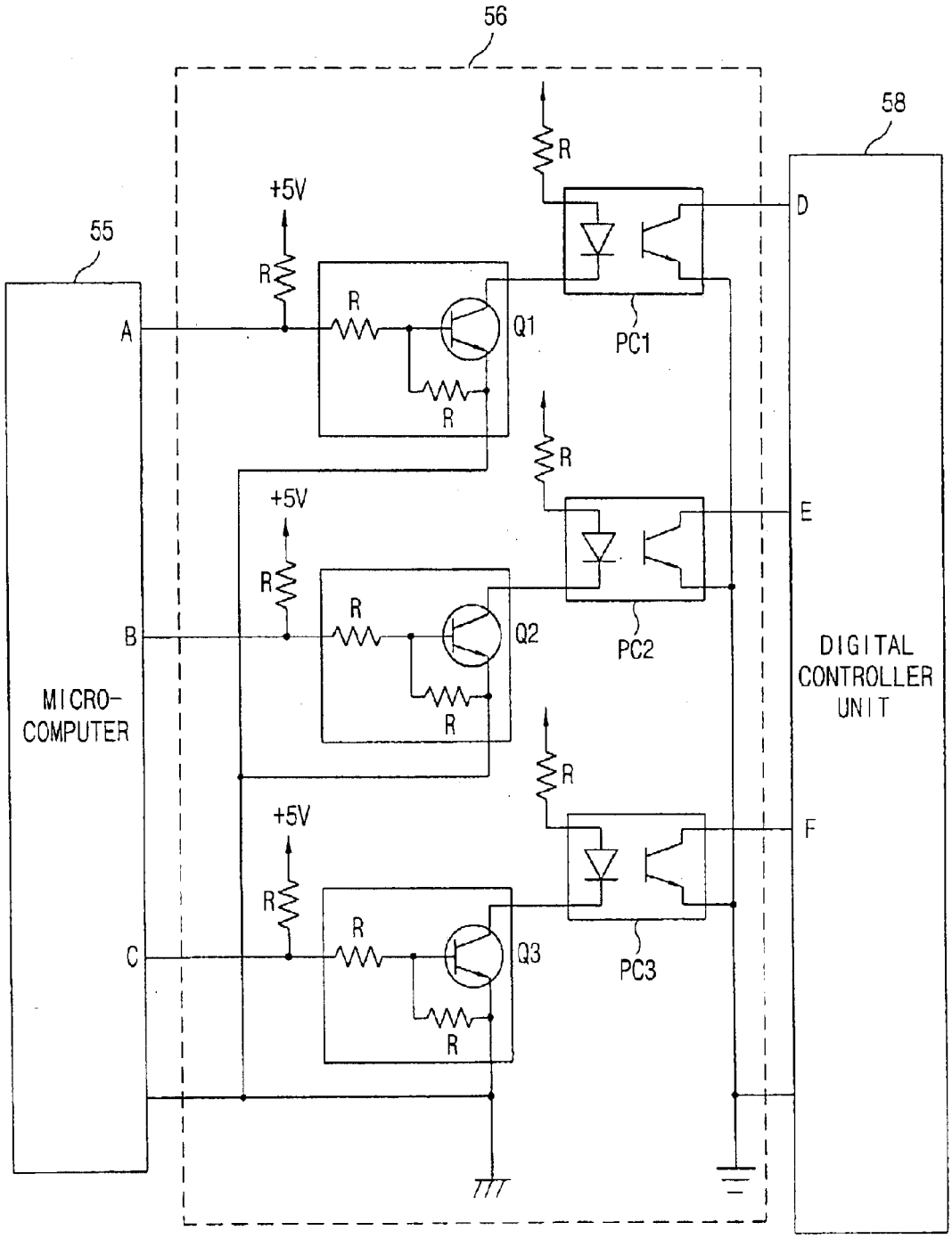
FIG. 6 is a circuit diagram illustrating a construction of a communication unit of FIG. 5.

FIG. 6 is a circuit diagram illustrating a construction of the communication unit 56 of FIG. 5.

As depicted in FIG. 6, the communication unit 56 is constructed with a first, a second, a third NPN transistors Q1, Q2, Q3 separately turned on/off in accordance with the coded failure relation information outputted from the microcomputer 55 and a first, a second, a third photocouplers PC1, PC2, PC3 separately connected to the first, second, third NPN transistors Q1, Q2, Q3 and separately and electrically connected in accordance when the first, second, third NPN transistors Q1, Q2, Q3 are turned on.

The operation of the service request system of the refrigerator using the Internet in accordance with the second embodiment of the present invention will now be described in detail with reference to accompanying FIGS. 5–7.

First, the power unit 54 supplies the AC power to the microcomputer 55, The microcomputer 55 sets the self-checkup function in accordance with an order signal outputted from the input unit 52 after being received the AC power supplied form the power unit 54 and controls the each part of the refrigerator 38. In addition, after setting the self-checkup function, the microcomputer 55 controls the load unit 53 by being inputted the sense signal outputted from the temperature sensing unit 57 sensing a temperature inside the freezing chamber and the cooling chamber. Herein, the load unit 53 operates a motor (not shown) of a compressor inside the refrigerator 38 in accordance with th control signal outputted from the microcomputer 55.

After that, the microcomputer 55 outputs the control signal to the display unit 51. Herein, the display unit 51 displays a present state of the refrigerator 38 in accordance with the control signal outputted from the microcomputer 55. Herein the present state can be information such as temperature information inside the freezing chamber and the cooling chamber or execution information executed in accordance with the operation of the user.

When the temperature inside the freezing chamber and the cooling chamber is inputted through the temperature sensing unit 57, the microcomputer 55 judges whether the temperature inside the freezing chamber and the cooling chamber is higher than an initial set temperature, when the temperature inside the freezing chamber and the cooling chamber is lower than the initial set temperature, the microcomputer 55 controls the load unit 53 so as to turn off the motor of the compressor. In addition, when the temperature inside the freezing chamber and the cooling chamber is higher than the initial set temperature, the microcomputer 55 controls the load unit 53 so as to turn on the motor of the compressor. Herein, the microcomputer 55 checks a failure state of the each part of the refrigerator 38, when a failure occurs, the microcomputer 55 codes failure relation information corresponded to the failure and outputs the coded failure relation information to the communication unit 56. Herein, the microcomputer 55 further includes a ROM (Read Only Memory) (not shown) storing each code number about the failure relation information.

The communication unit 10 is inputted the coded failure relation information outputted from the microcomputer 55 and transmits the coded failure relation information to the digital controller unit 58.

The digital controller unit 58 is inputted the coded failure relation information transmitted from the communication unit 56, converts it into character information (signal) by performing digital signal-processing, and transmits the character information to the automatic mail transmitting unit 59.

The automatic mail transmitting unit 59 automatically transmits the character information transmitted from the digital controller unit 58 to the designated service center 31 or an electric mail address of the serviceman through the electronic mail. Herein, the automatic mail transmitting unit 59 transmits together the failure relation information with the user's address, the user's telephone number, the user's name, the model name or model number of the product (refrigerator), the original number of the product (refrigerator), etc. stored in the database 60 to the electronic mail address of the serviceman.

Hereinafter, the operation of the communication unit 56 will now be described in detail.

First, when a failure occurs in the compressor of the refrigerator 38, the microcomputer 55 generates a code of '100', a 'high' signal, a 'low' signal and a 'low' signal are separately outputted from output ends (A), (B), (C) of the microcomputer 55.

After that, the first NPN transistor Q1 of the communication unit 56 is turned on by the 'high' signal, accordingly '+5V' flows to a grounding through a first photo diode inside the first photocoupler PC1 and the first NPN transistor Q1. Herein, the first photocoupler PC1 is electrically connected, the first photo register inside the first photocoupler PC1 is turned on, the 'high' signal applied to a collector end of the first photo register flows to the grounding through an emitter, and the 'low' signal is inputted to the first input end (D) of the digital controller unit 58.

In the meantime, the second and the third NPN transistors Q2, Q3 of the communication unit 56 are turned off by the 'low' signal of the output ends (B), (C) of the microcomputer 55, the connection between the second and the third photocouplers PC2, PC3 is electrically cut off, the 'high' signal is inputted to the second and the third input ends (E), (F) of the digital controller unit 58. In more detail, when the microcomputer 55 codes "100", the microcomputer 55 inputs '011' to the digital controller unit 58, a failure mode can be made with 3×3 combination. If the number of bit of the code is expanded, some more failure modes can be made through combination of the number of the expanded bit.

Figure 7:
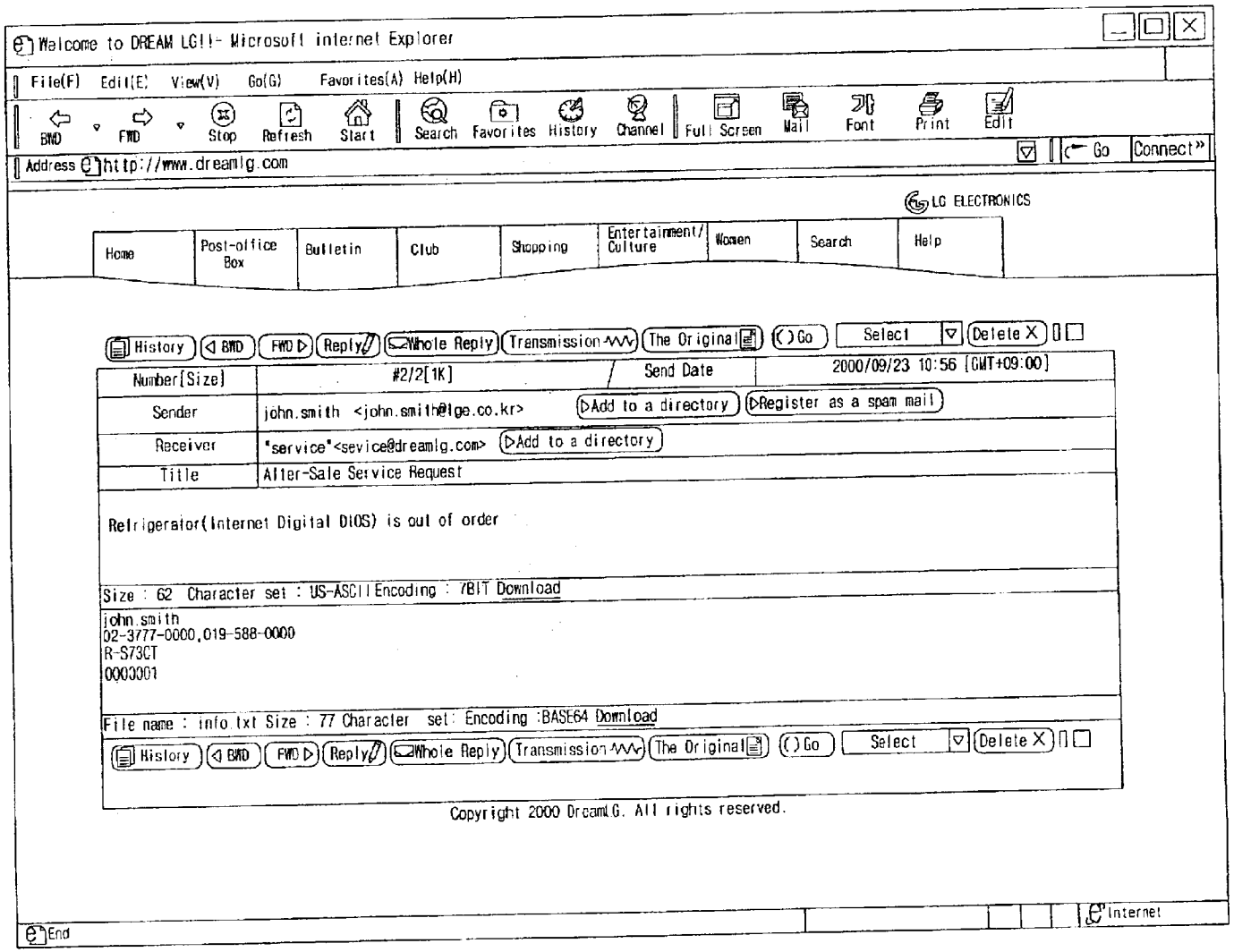
FIG. 7 is a screen illustrating a post-office box of a service center or a serviceman.

FIG. 7 is a screen illustrating a post-office box of a service center or a serviceman.

Hereinafter, the operation of the communication unit 56 will now be described in detail. In more detail, a post-office box of the designated service center 31 or the serviceman receiving automatically the electronic mail transmitted from the automatic mail transmitting unit 59 is depicted in FIG. 7.

Accordingly, a refrigerator and a method for controlling the same in accordance with the present invention is capable of repairing quickly and accurately a failure of a refrigerator by transmitting automatically failure relation information from a refrigerator itself to a designated service center or serviceman through an electronic mail when a failure occurs in each part or function of the refrigerator.

As described above, the refrigerator and the method for controlling the same in accordance with the present invention can instantly and accurately sense a failure of a refrigerator and can repair the failure of the refrigerator by transmitting automatically failure relation information from a refrigerator itself to a designated service center or serviceman through an e-mail although a user does not recognize the failure of the refrigerator when the failure occurs in each part or function of the refrigerator.

In addition, the refrigerator and the method for controlling the same in accordance with the present invention can prevent spoilage of food although a user does not recognize a failure of the refrigerator by transmitting automatically failure relation information from a refrigerator itself to a designated service center or serviceman through an electronic mail when the failure occurs in each part or function of the refrigerator.

In addition, the refrigerator and the method for controlling the same in accordance with the present invention can solve inconvenience of a user when the user recognizes a failure of a refrigerator, but the user can not know a cause of the failure by transmitting automatically failure relation information from a refrigerator itself to a designated service center or a serviceman through an electronic mail when the failure occurs in each part or function of the refrigerator.

What is claimed is:

1. A method for controlling a product, comprising:

receiving information manually input from a user indicating a failure state of the product;

generating failure related information corresponding to the failure state;

transmitting the failure related information through a network;

determining whether the failure related information transmitted through the network was received at an intended destination; and displaying contact information of a service center on a display of the product if the failure related information was not received at the intended destination.

2. The method of claim 1, further comprising:

performing a self-checkup operation which includes sensing a error condition of the product; and automatically transmitting information indicative of the error condition through a network.

3. The method of claim 2, further comprising:

receiving information manually input by a user for setting the self-checkup operation.

4. The method of claim 2, wherein the product is a refrigerator, and wherein the self-checkup operation includes:

sensing data corresponding to at least one of a temperature state inside a storage space of the refrigerator and a power state of the refrigerator;

comparing the sensed data to preset failure reference data; and sensing the failure state in accordance with a result of the comparing step.

5. The method of claim 1, further comprising:

automatically retrieving at least one of user information and intrinsic information of the product from a database; and transmitting at least one of the user information and intrinsic information of the product with the failure relation information through the network.

6. The method of claim 1, wherein the failure related information is transmitted through an electronic mail.

7. The method of claim 1, further comprising:

receiving information manually input by the user setting a manual service request operation; and displaying a prompt on a display of the product requesting the user to manually enter said failure state information.

8. The method of claim 1, further comprising:

displaying a message on a display of the product indicating that contact failure occurred if the failure related information was not received at the intended destination.

9. The method of claim 1, further comprising:

receiving a confirmation through the network indicating that the failure state information was received; and displaying information indicative of the confirmation on a display of the product.

10. The method of claim 1, wherein the failure state information is manually input by the user using an input device of the product.

11. The method of claim 1, wherein the network includes the Internet.

* * * * *